US005123171A

United States Patent [19]

Langston

[11] Patent Number: 5,123,171

[45] Date of Patent: Jun. 23, 1992

[54] IRREGULAR SURFACE ELLIPSOGRAPH

[76] Inventor: Charles F. Langston, 2920 E. 26th Pl., Tulsa, Okla. 74114

[21] Appl. No.: 710,820

[22] Filed: Jun. 5, 1991

[51] Int. Cl.[5] ..... B43L 11/045

[52] U.S. Cl. ..... 33/30.5; 33/30.1; 33/DIG. 1

[58] Field of Search ..... 33/18.1, 30.1-30.5, 33/409, 410, 413, 756, DIG. 1, 27.01

[56] References Cited

U.S. PATENT DOCUMENTS

| | | | |
|---|---|---|---|
| 149,474 | 4/1874 | Hazen | 33/30.5 |
| 758,314 | 4/1904 | Hanlon | 33/30.5 |
| 768,997 | 8/1904 | Johnson | 33/30.5 |
| 950,696 | 3/1910 | Herman | 33/489 |
| 1,116,549 | 11/1914 | Berg | 33/30.5 |
| 1,188,900 | 6/1916 | Clogston et al. | 33/30.5 |
| 1,230,994 | 6/1917 | Caldwell | 33/30.5 |
| 1,571,777 | 2/1926 | Golden | 33/27.01 |
| 2,667,695 | 2/1954 | Price | 33/409 |
| 2,834,112 | 5/1958 | Seagraves | 33/409 |
| 3,145,477 | 8/1964 | Morrison | 33/DIG. 1 |
| 3,823,478 | 7/1974 | Farmos | 33/30.5 |
| 3,947,968 | 4/1976 | Rosenheck | 33/30.5 |

*Primary Examiner*—Allan N. Shoap
*Assistant Examiner*—Alvin Wirthlin

[57] ABSTRACT

An apparatus, of a compact pocket-sized design, for the description of accurate ellipses of an infinite number of conjugate and transverse diameters on flat and/or irregular surfaces, such as spherical or horizontal and vertical cylindrical tanks, having two identical, independent focal-point holders, a non-elastic inter-connecting cord and a variety of inter-changeable mounting bases to allow the mounting of the focal-point holders on soft, porous, non-porous, textured and metallic surfaces.

13 Claims, 2 Drawing Sheets

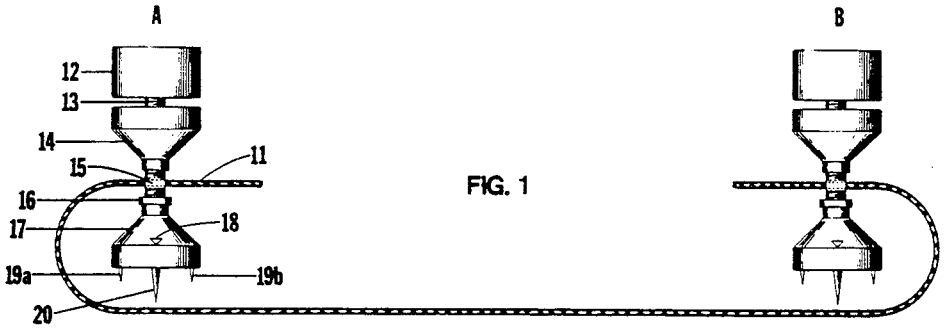
FIG. 1
FIG. 2
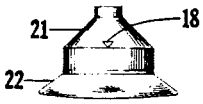
FIG. 3
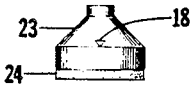
FIG. 4
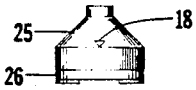
FIG. 5
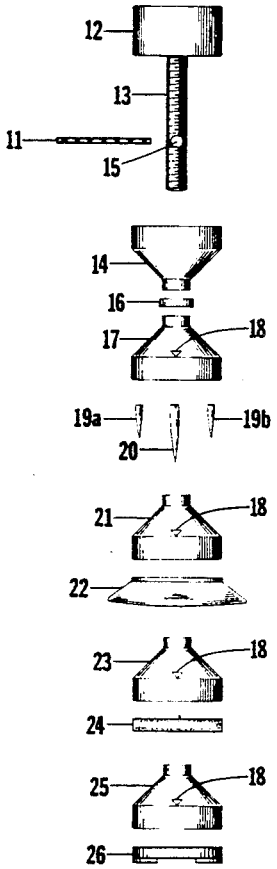
FIG. 6
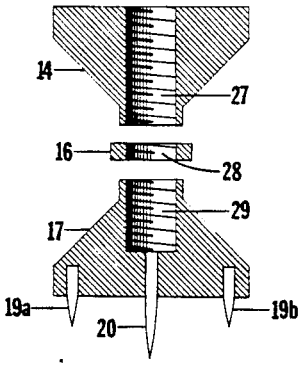
FIG. 7
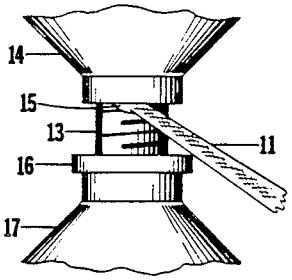
FIG. 8
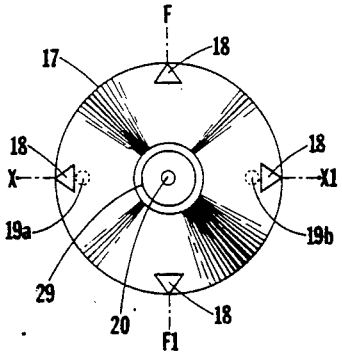

IRREGULAR SURFACE ELLIPSOGRAPH

BACKGROUND OF THE INVENTION

It is well known in the drafting, graphic arts and signage communities that an ellipse may be described through the use of templates or various devices which employ a slackly-strung non-elastic cord between two fixed focal points. Historically, several devices have been developed which simplify the description of ellipses by providing bases having adjustable means whereby the distance between the focal-points is readily adjustable and variable to accommodate the requirement for the creation of an infinite number of different ellipses having differing conjugate and transverse diameters.

A number of such devices are exemplified in the prior art, such as in the disclosure by Hazen in U.S. Pat. No. 149,474 wherein a wooden base having a sliding adjustable and frictionally lockable member by means of which the distance between the two focal-points or focii may be varied. In U.S. Pat. No. 707,580 Gregory taught a similar method employing a series of spaced-apart holes in an elongated base to provide adjustments to both the distance between the focii and the length of the cord therebetween as well as providing a pivotally mounted roller for a scribing or cutting device. Johnson, in U.S. Pat. No. 768,997 disclosed yet another device having two slidably adjustable and lockable means for varying the inter-focal dimension and provided a spring-loaded means for securing the adjustable end of the inter-connecting cord. Higgins et al., in U.S. Pat. No. 888,709 taught a method of expanding the dimensional capabilities of the preceding devices through the use of extensible tape having means for attachment to the flexible cords of said devices. In U.S. Pat. No. 1,116,549 Berg teaches a method for adjusting the relative conjugate and transverse diameters of ellipses through the utilization of two independent focal-points, each having clutch means for adjusting and maintaining the length of the inter-connecting cord therebetween. Clogston et al,. in U.S. Pat. No. 1,118,900 discloses a method whereby the flexible cord used to encircle the focii is provided with a spool or reel for its storage and locking means to adjust the length of the cord to be used also comprising a rotatable sleeve wherein the pencil or describing means is inserted. In U.S. Pat. No. 1,488,641 Johnston disclosed a device bearing a close resemblance to a vernier caliper, graduated along its length to facilitate adjustment and reduce set-up time. In U.S. Pat. No. 3,224,098 Terrell revealed an ellipse scriber in the form of a beam compass wherein various components are adjustably clamped to a conventional yardstick thereby providing calibrated means to describe ellipses of various configurations. Lastly, Rosenheck, in U.S. Pat. No. 3,947,968 discloses a device, bearing a striking resemblance to the earlier disclosure of Hazen, which has as its principal difference the addition of graduated markings and a cord-follower adapted to accept a marking or scribing instrument.

While all these examples of the prior art possess merit and provide useful and effective means of describing ellipses of various diameters and configurations, it is apparent that none of these inventors have recognized, addressed or anticipated the problem that the present invention is expressly designed to solve.

OBJECT OF THE INVENTION

In the commercial and graphic arts and signage communities, as well as in the wood working, metal crafting and ornamental iron work industries, it is frequently necessary to describe large ellipses which are beyond the capabilities of the devices of the prior art. Further, it is frequently necessary to describe these ellipses on other than planar surfaces, i.e., upon surfaces such as those of horizontal and vertical cylindrical or spherical tanks as are used for the storage of liquids and gasses or upon the arcuate facades of structures fabricated of various materials having widely divergent surface textures ranging from smooth, non-porous glass to concrete, brick and stone. When the aforementioned conditions are encountered, the devices of the prior art are incapable of providing either the extended dimensional requirements for describing large ellipses or a secure means of attachment of the focii to these varied surface compositions and textures. It is the object of the present invention to provide a simple, easily employed apparatus to facilitate the accurate description of these ellipses on horizontal and/or vertical surfaces without regard for the transverse and conjugate diameters thereof, the texture or composition of the surface upon which they are to be described, the configuration of that surface, be it flat, cylindrical or spherical, or the plane of that surface, be it horizontal, vertical or at any angle therebetween, said apparatus being convenient to use, economical to purchase and of a compact configuration to permit ease of transport and facility of use.

BRIEF DESCRIPTION OF THE DRAWING FIGURES

FIG. 1 is an elevational depiction of the complete apparatus in assembled form showing the two identical focus-point bases A and B and the inter-connecting cord delineating the manner in which the cord passes through them, also showing the anchor points used to retain the bases of the focii in the desired positions on a soft, wood-like surface.

FIG. 2 depicts, in elevational view, one of the two identical base members having a suction-cup means to retain the bases of the focii in the desired positions on a smooth, non-porous surface such as glass or non-ferrous metals such as aluminum or certain stainless steels.

FIG. 3 depicts, in elevational view, one of the two identical base members having an adhesive disc means used to retain the bases of the focii in the desired positions on porous, semi-porous or textured surfaces such as concrete, brick or stone.

FIG. 4 depicts, in elevational view, one of the two identical base members having magnetic means used to retain the bases of the focii in the desired positions on surfaces such as cast-iron or steel.

FIG. 5 is an exploded elevational view of the apparatus showing the sequence of assembly and the various means utilized to retain the bases of the focii in the desired positions.

FIG. 6 depicts the internal threading of the base, the cord-clutch member and the locking nut in a sectional elevational view.

FIG. 7 is an enlarged elevational view of the base, the cord-clutch and the locking nut members in position on the threaded thumb-screw, depicting in enhanced detail, the transverse hole, the manner in which the interconnecting cord is retained and the manner in which the locking nut engages the base member to prevent rotation of the thumb-screw within the threads of the base member to maintain the alignment of the transverse hole with the longitudinal base line of the ellipse.

FIG. 8 depicts one of the two identical base members of the apparatus in plan or overhead view, illustrating the location and form of the indexing marks, the central threaded hole and the location of the sockets which accommodate the anchor points.

Figure 9:
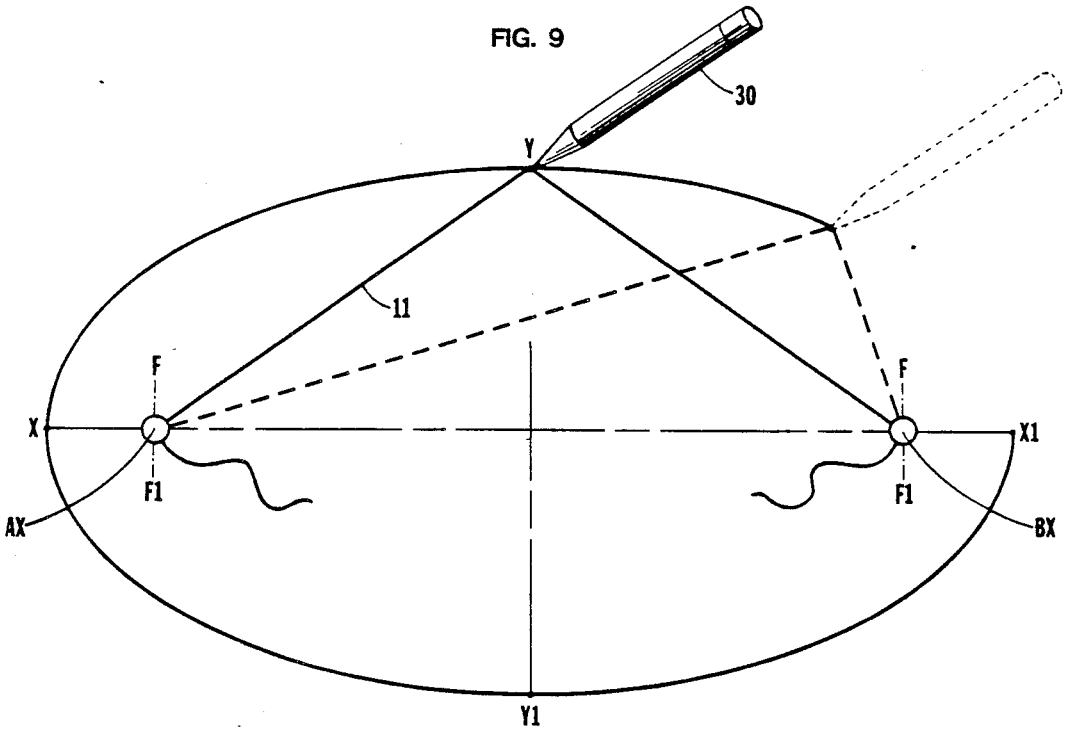

FIG. 9 illustrates the manner in which the dimensions of the ellipse are established and the manner in which the marking or scribing means describes the ellipse.

Figure 10:
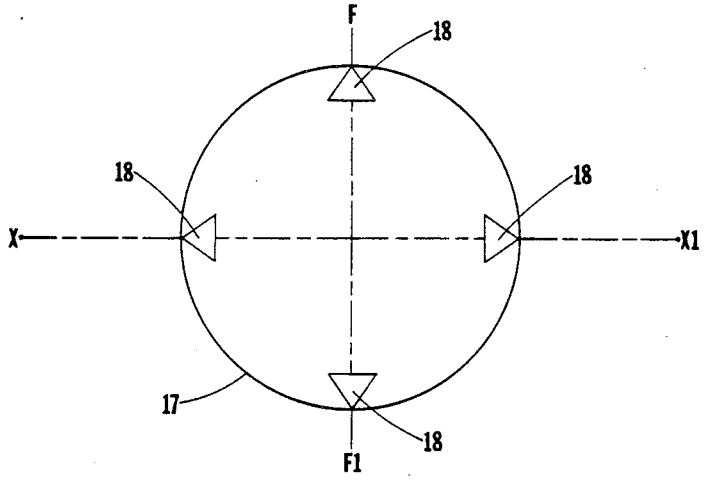

FIG. 10 is an illustration of the placement of the base member on the pre-established dimension lines and the alignment of the index marks with said lines.

THE PREFERRED EMBODIMENT OF THE INVENTION

Referring now, in greater detail, to the FIGS. OF THE DRAWINGS will disclose the preferred embodiment of the present invention as an apparatus for the accurate description of ellipses of various transverse and conjugate diameters on planar and/or irregular surfaces such as spheres or vertical or horizontal cylinders, said apparatus being adapted for focal-point attachment to surfaces of a wide range of compositions, textures and porosities, to facilitate the creation of ellipses of any reasonable dimension thereupon.

In FIGS. 1 and 6, two focal-point assemblies, being constructed of metal, or a suitable plastic, are identified as A and B, each being identical in all respects with the other comprise a base or anchor member 17 which is threaded internally 29 at the center of its diameter to receive a correspondingly threaded screw 13 said screw having at the upper end thereof an enlarged diameter portion 12 which is knurled, serrated or otherwise roughened about the periphery thereof to adapt it to be gripped by the fingers for purposes of location and adjustment. Said threaded screw 13 has sequentially positioned along the length thereof an internally threaded 27 cord-clutch member 14 and an internally threaded 28 lock nut member 16. The assembly of the various components is shown to advantage in FIG. 5 wherein the various members are illustrated in an exploded view indicating the manner in which threaded screw 13 passes in threaded engagement through cord-clutch member 14 and lock nut member 16 and thence into the threaded portion 29 of base member 17. Said base member is, in this instance, provided with a centrally positioned anchor pin 20 and a plurality of anti-rotational pins **19*a* and 19*b* which are adapted to prevent rotation of the base member 17 about the axis of anchor pin 20 when the base member is installed on penetrable surfaces. As is illustrated to advantage in FIG. 7, the threaded portion 13 of thumb-screw 12 is provided with a diametric bore 15, of a dimension to loosely accommodate the passage of a non-elastic cord 11 such as fishing line of woven or braided construction, said diametric bore being positioned to be slightly above the upper face of lock nut member 16 when the threads 13 of thumb-screw 12 are fully entered into the threaded bore 29 of base member 17 and lock nut 16 is turned into locking engagement with threads 13 and the upper horizontal surface of base member 17. Diametric bore 15 being sized to accommodate the passage of cord 11 is provided with a locking means in the form of cord-clutch member 14 which, as previously stated, also comprises a threaded bore 27 and is in threaded engagement with the threaded portion 13 of thumb-screw 12 above the diametric bore 15 which passes therethrough. Said cord-clutch member 14, being in threaded engagement with the threaded portion 13, may be turned into crimping engagement with cord 11 which passes through bore 15 to prevent the movement of said cord 11 through said bore 15 when said cord 11 is drawn taut during the description of an ellipse. As the apparatus is also adapted for mounting on smooth, non-porous surfaces, such as glass or non-ferrous metal, an alternate base member 21, shown in FIG. 2, being identical in all other respects, comprises a rubber or plastic suction-cup 22 in lieu of the anchor and anti-rotational pins of FIG. 1, said suction-cup being fixedly attached to base member 21 adapts said base member to be pressed onto a non-porous surface where it is securely, yet removably retained by the internal vacuum within the confines of said suction-cup without damage to, or marring of, the mounting surface. Base member 23 depicted in FIG. 3, is again identical in all respects to the aforesaid base member 17 and base member 21, with the singular exception of the means of attachment to the surface upon which an ellipse is to be described. Base member 23 comprises a disc cut from "Scotch-Mount VHB TM", Double Coated Acrylic Foam Tape "3-M Brand TM", or a similar equal. Said adhesive foam being of the "pressure sensitive"type is ideally suited for attaching the focal-point base members A and B to surfaces of concrete, brick or stone. Following use, the foam disc 24, being adhesively attached to base member 23 may be removed for disposal and new discs applied. The base member 25, depicted in FIG. 4, is again identical in all other respects to the aforesaid base members 17, 21 and 23 with the singular exception of the means of attachment to the surface upon which an ellipse is to be described. Base member 25 comprises a permanent magnet 26** fixedly attached to the base thereof to adapt the apparatus for attachment to surfaces of ferrous metals such as steel and cast-iron. It should be readily apparent that the various configurations of the focal-point bases make them adaptable to mounting in a spaced-apart relationship on any surface, in any orientation, to provide the capability to describe ellipses of any reasonable dimensions.

The focal-point bases additionally comprise indexing marks 18 which are shown to advantage in FIG. 8 and FIG. 10, said marks being situate about the periphery of the base members at intervals of 90°. Said index marks, making possible the accurate alignment of the focii with the pre-established longitudinal base line and the intersecting transverse lines, provide for exact placement of the focii to obtain maximum accuracy in the description of the ellipse, when the apparatus is employed in the manner hereinafter explained and as illustrated to advantage in FIG. 9.

When the size of the ellipse, i.e., the length and height thereof, has been determined, a line is inscribed from point X to point X1 to designate the length of the ellipse and a line perpendicular thereto is inscribed at the mid-point thereof and the determined height of the ellipse is designated thereupon as point Y or Y1. Half of the length of line X–X1, measured from either Y or Y1 to intersect line X–X1 establishes the location of focal-points AX and BX and perpendicular lines F–F1 are inscribed to facilitate accurate location of focal-point holders A and B. Focal-point bases appropriate to the surface upon which they are to be installed are selected and the threaded portions 13 of thumb-screws 12 (having cord-clutch members 14 and lock nut members 16 sequentially installed thereupon) are entered into threaded engagement with said appropriate bases. Index marks 18 are then aligned with lines X–X1 and F–F1 and the assembled focal-point holders A and B are pressed into place where they are securely retained by the anchor pins 20, the suction-cups 22, the adhesive discs 24 or the permanent magnets 26 appropriate to the mounting surface. The thumb-screws 12 are adjusted to bring the transverse holes 15 into parallel alignment with the major axis X–X1 and the lock nuts 16 are turned down into locking engagement with the upper horizontal surface of the base members to maintain said alignment. The ends of the inter-connecting cord 11 are passed through the transverse holes 15 from the distal sides thereof and the cord-clutch member 14, of A or B, is turned down into crimping engagement therewith. The opposing end of said cord is passed around a pen, pencil, scriber or other appropriate marking means positioned at point Y or Y1 and said cord is drawn taut through the opposing transverse hole 15 and the cord-clutch member 14 of the opposing focal-point holder (A or B) is also turned down into crimping engagement with said cord. The apparatus is thus prepared for the description of an ellipse.

The ellipse is described by placing the marking means 30 at point Y and while maintaining cord 11 in a taut condition, drawing the marking means to either of the X points, thus describing one-quarter of the ellipse and then from the Y point to the opposing X point to describe the opposing one-quarter. Alternatively, the marking means may be placed at either of the X points and while maintaining the cord in a taut condition drawn to the opposing X point thus describing one-half of the ellipse in one smooth arcuate line. Upon completion of the description of one-half of the ellipse the cord is lifted over the focal-point assemblies to the opposing side and the remainder of the ellipse is described in a similar manner.

It will be readily appreciated that the present invention represents a major improvement over the prior art in that not only does it facilitate the description of ellipses of great dimension, by providing focal-point assemblies independent of a limiting elongated base member, it provides the capability for attachment of focal-point bases to an unlimited number of surface compositions and textures and allows the description of accurate ellipses of pre-determined dimensions on irregular surfaces such as those of cylinders and spheres.

While there has herein been shown and described the presently preferred embodiment of this invention, it should be understood that such has been done for purposes of illustration only, and that certain changes, modifications, alterations and adaptations may be made thereto within the scope of the appended claims.

What I claim is:

1. Apparatus for the accurate description of ellipses of various conjugate and transverse diameters on planar and irregular surfaces of various compositions, textures and porosities comprising in combination:

a) a plurality of pairs of interchangeable focal-point base members, each pair having different securing means located at a lower end of each base member for attachment to said surfaces;

b) indexing means located on each base member, whereby said focal-point base members can be accurately aligned with plotted dimensional lines;

c) cord length maintaining means engaging an upper end of each base member, whereby an interconnecting cord can be adjusted to a desired length, said cord length maintaining means including crimping means, whereby an inter-connecting cord can be retained in the adjusted position resisting movement in any direction;

d) threadably transferrable means associated with each base member and cord length maintaining means, whereby said cord length maintaining means can be changed form one of said pairs of focal-point base members to another; and e) an inter-connecting, non-elastic cord adapted to connect one of said pairs of focal point base members through said cord length maintaining means.

2. The apparatus of claim 1 wherein said securing means of one of said pairs of focal-point base members comprise:

a) a centrally positioned anchor pin of a pointed configuration;

b) a plurality of anti-rotational pins of a pointed configuration located adjacent to said anchor pin.

3. The apparatus of claim 1 wherein said securing means of one of said pairs of focal-point base members comprise suction-cup means for their retention on non-porous surfaces.

4. The apparatus of claim 1 wherein said securing means of one of said pairs of focal-point base members comprise adhesive means for their retention in desired positions on textured surfaces.

5. The apparatus of claim 4 wherein said adhesive means is removable and replaceable.

6. The apparatus of claim 1 wherein said securing means of one of said pairs of focal-point base members comprise permanent magnet means for their retention in desired positions on surfaces composed of ferrous metals.

7. The apparatus of claim 1 wherein said cord length maintaining means is threadably transferrable between any pair of similar or dis-similar focal-point base members.

8. The apparatus of claim 6 wherein said threadably transferrable cord length maintaining means comprises a threaded screw engaging said base member, said threaded screw having a transverse hole; said cord adapted to pass through said transverse hole.

9. The apparatus of claim 8 wherein said threadably transferrable cord length maintaining means comprises lock-nut means engageable with said threaded screw.

10. The apparatus of claim 7 wherein said lock-nut means is threadably engagable with each focal-point base member for locking said screw against each base member.

11. The apparatus of claim 8 wherein said threadably transferrable cord length maintaining means comprises a threadably positionable cord-clutch member engaging said threaded screw and adapted to pass over said transverse hole, thereby crimping said inter-connecting, non-elastic cord at the point of passage of said cord through said transverse hole.

12. The apparatus of claim 1 wherein the form of each base member is substantially that of a truncated cone upon a short cylindrical base.

13. The apparatus of claim 1 wherein said indexing means comprises a calibrated point at each 90° about the periphery of each of said focal-point base members.

* * * * *